US006196660B1

(12) United States Patent
Park

(10) Patent No.: US 6,196,660 B1
(45) Date of Patent: Mar. 6, 2001

(54) APPARATUS FOR ROTATING A PRINT HEAD TO INCREASE PRINTING RESOLUTION

(75) Inventor: Jin-Ho Park, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 08/936,115

(22) Filed: Sep. 24, 1997

(30) Foreign Application Priority Data

Sep. 24, 1996 (KR) ..... 96-31137

(51) Int. Cl.[7] ..... B41J 23/00
(52) U.S. Cl. ..... 347/37
(58) Field of Search ..... 347/44, 40, 37, 347/49; 400/82; 395/108; 358/296

(56) References Cited

U.S. PATENT DOCUMENTS 5,241,325 8/1993 Nguyen ..... 347/49
5,488,397 * 1/1996 Nguyen et al. ..... 347/40
5,642,948 * 7/1997 Harris et al. ..... 347/40

FOREIGN PATENT DOCUMENTS 2 134 045 * 8/1984 (GB) ..... 347/44
54-158232 * 12/1979 (JP) ..... 347/40

* cited by examiner

*Primary Examiner*—N. Le
*Assistant Examiner*—Judy Nguyen
(74) *Attorney, Agent, or Firm*—Robert E. Bushnell, Esq.

(57) ABSTRACT

A resolution control apparatus for an ink-jet printer, having a carriage conveying a printer head reciprocally across the width of the medium being printed, includes an angle controller for controlling an installation angle of the printer head incrementally, in discrete stages, in order to control vertical resolution. Sensors detect the selected installation angle of the printer head and generate a print control signal according to the sensed angle.

27 Claims, 7 Drawing Sheets

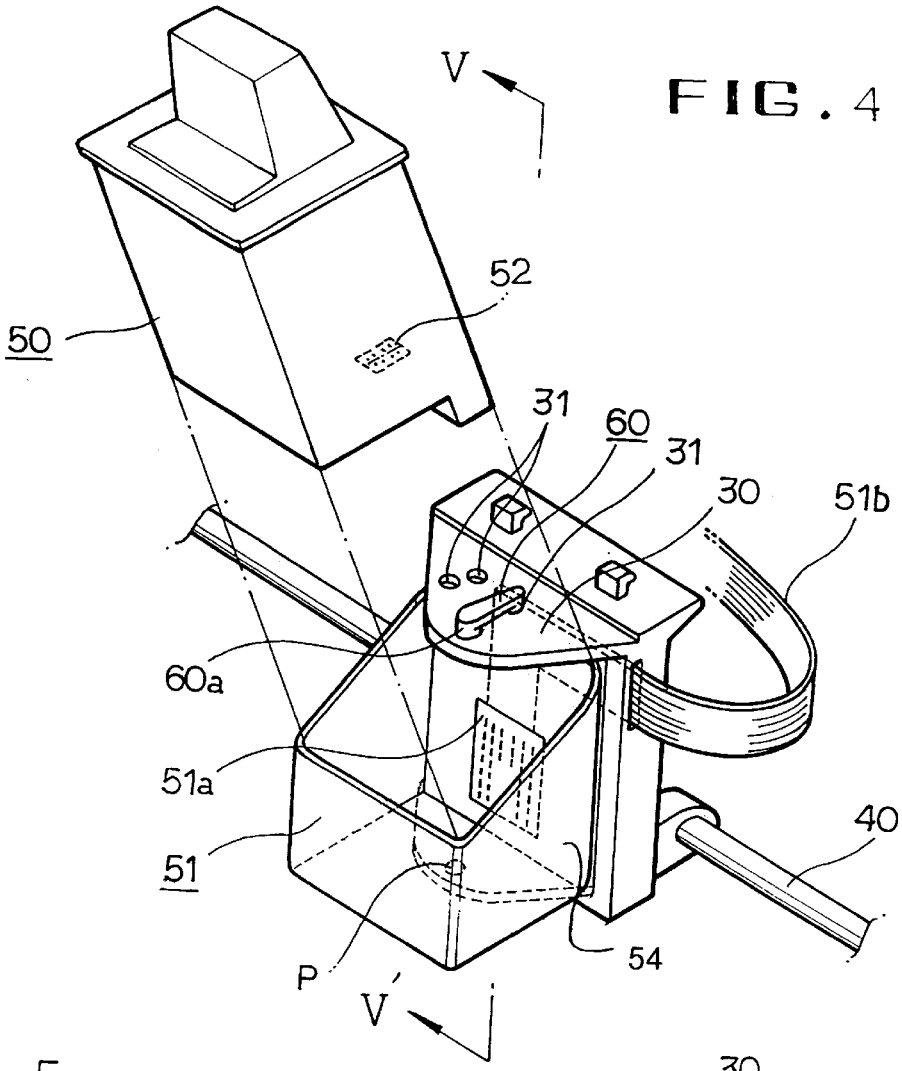
FIG. 4
FIG. 5
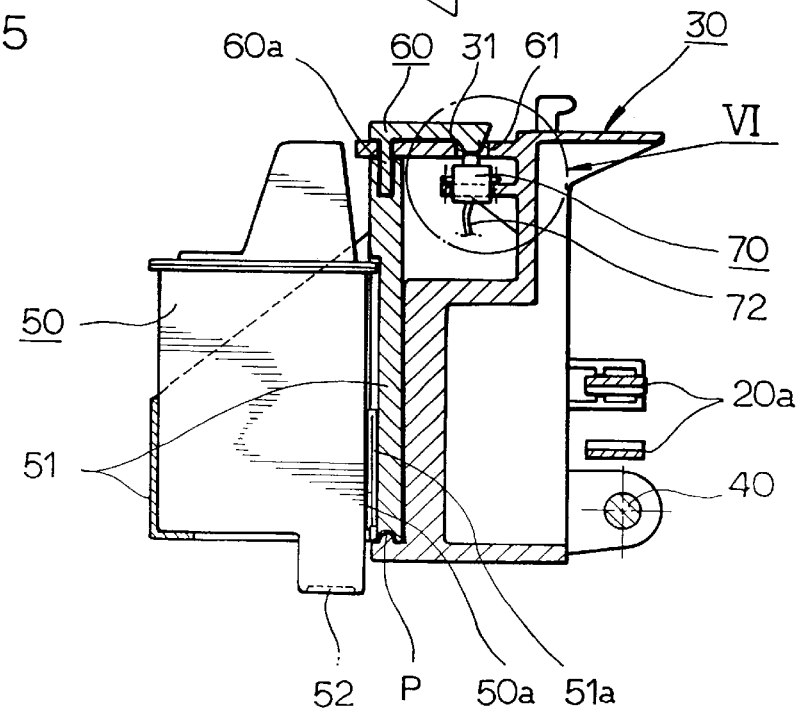

APPARATUS FOR ROTATING A PRINT HEAD TO INCREASE PRINTING RESOLUTION

CLAIM FOR PRIORITY

This application makes reference to, incorporates the same herein, and claims all benefits accruing under 35 U.S.C. § 119 from an application entitled Resolution Control Apparatus For Ink-Jet Printer earlier filed in the Korean Industrial Property Office on Sep. 24, 1996, and there duly assigned Serial No. 96-31137 by that Office.

BACKGROUND OF THE INVENTION

1. Field of the Invention

The present invention relates to a resolution control apparatus and process for controlling an ink-jet printer and, more particularly, to an apparatus able to control printing resolution in the direction that a medium in transported through an ink-jet printer.

2. Discussion of Related Art

Generally, ink-jet printers drive a printing head and carriage in tandem laterally across the width of the medium being printed in a dot-matrix format. Horizontal resolution along the direction of the movement of the printer head across a sheet of paper is limited but controllable. I have found that vertical resolution, that is the resolution of printing on a page in the direction that the page in transported along while passing through an ink-jet printer can not be satisfactorily controlled even when the array of nozzles are attached to the print head in a tilted fashion, because the resolution in the direction of paper transfer is limited by the spacing between the nozzles. Consequently, I have found that contemporary devices for regulating resolution of ink-jet printing have restricted the quality of print obtainable.

SUMMARY OF THE INVENTION

Accordingly, the present invention is directed to a resolution control apparatus for an ink-jet printer that substantially obviates one or more of the problems, limitations and disadvantages of the related art.

It is therefore an object of the present invention to provide an improved apparatus for controlling the resolution of printing by an ink-jet printer.

It is another object to provide a resolution control apparatus for an ink-jet printer to minimize the nozzle interval of a printer head.

It is still another object to provide an apparatus able to attain high-resolution printing.

It is yet another object to provide an apparatus that enables a user to incrementally, selectively control high-resolution low-speed printing or low-resolution high-speed printing.

Additional features and advantages of the invention will be set forth in the description which follows, and in part will be apparent from the description, or may be learned through practice of the invention. These objects and other advantages of the invention will be realized through the techniques and structures as are particularly pointed out in the written description and claims hereof, as well as in the appended drawings.

To achieve these and other objects, and in accordance with the purpose of the present invention as embodied and broadly described, there is disclosed a resolution control apparatus for an ink-jet printer having a moving carriage transporting a printer head. Resolution control may be obtained in accordance with the principles of the present invention with an angle controller that incrementally regulates the installation angle of the printer head in stages, thereby controlling vertical resolution. A sensor detects the installation angle of the printer head and generates a print control signal according to the angle sensed.

To control vertical resolution, the angle of the nozzle array on the printing head is tilted with respect the direction of carriage movement. The angle controller may include a lever having a hemispherical protrusion engageable with each of a plurality of holes formed in the carriage and rotatable about a center of rotation of the printer head, and a printing head holder that is rotatable with the lever, for holding the printer head. Preferably, the sensor means is a contact switch positioned at each of the holes, that is activated by the hemispherical protrusion of the lever.

It is to be understood that both the foregoing general description and the following detailed description arc merely exemplary and are intended to provide further explanation of the invention as claimed.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 4 is a partially exploded perspective view of a printer head of an ink-jet printer, shown with respect to the carriage, constructed in accordance with the principles of the present invention;

FIG. 5 is a section view taken along line V–V' of FIG. 4;

DETAILED DESCRIPTION OF PREFERRED EMBODIMENT

Figure 1:
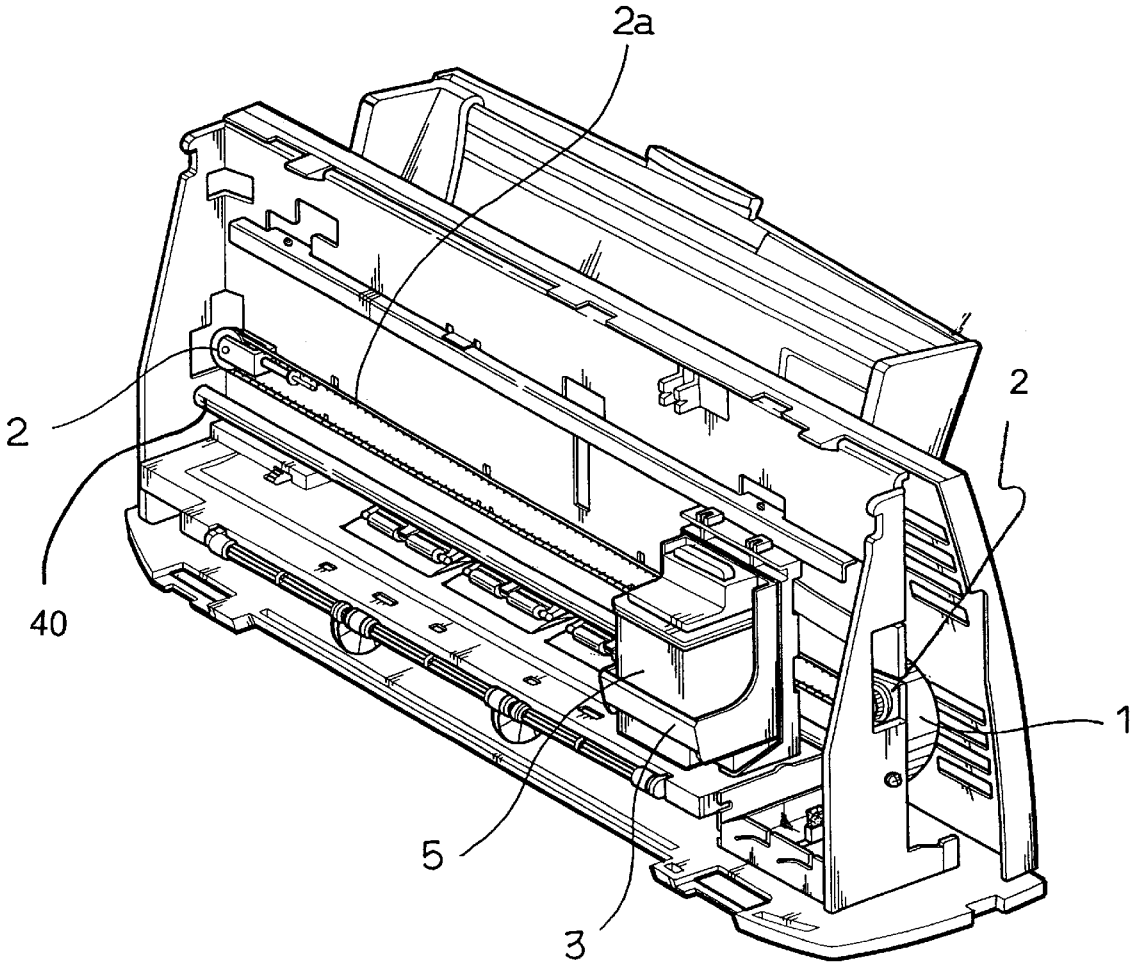
FIG. 1 is an overall perspective view of an ink-jet printer.
Figure 2:
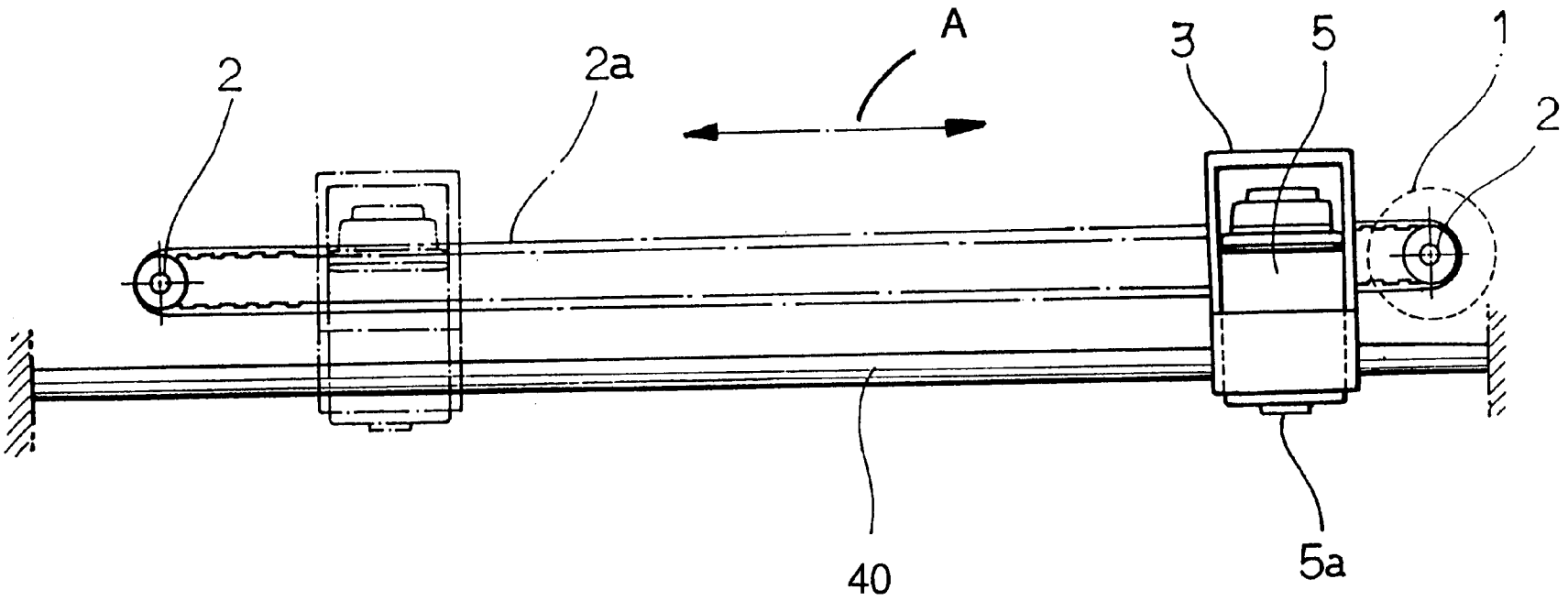
FIG. 2 is a side view of the functional components of the ink-jet printer shown in FIG. 1.

Turning now to the drawings and ink-jet referring to FIGS. 1 and 2, an printer generally includes a forward and reverse motor 1 for driving a timing belt 2*a* around a pair of timing pulleys 2, a carriage 3 engaged with the timing belt so as to travel laterally along a guide shaft 40, and a printer head 5 that reciprocates in tandem with the carriage horizontally across the width of the print medium and is provided with a plurality of nozzles 5*a* to form characters onto print media (e.g., paper) in a dot-matrix format. Horizontal resolution, i.e., the horizontal interval of each dot printed by the nozzles 5*a* in the direction of the movement of the printer head 5 across a sheet of paper by carriage 3, is limited but controllable. Vertical resolution, however, can not be controlled because the resolution in this direction (coinciding with the vertical direction of paper transfer) is normally fixed by the interval between nozzles 5*a*.

Figure 3A:
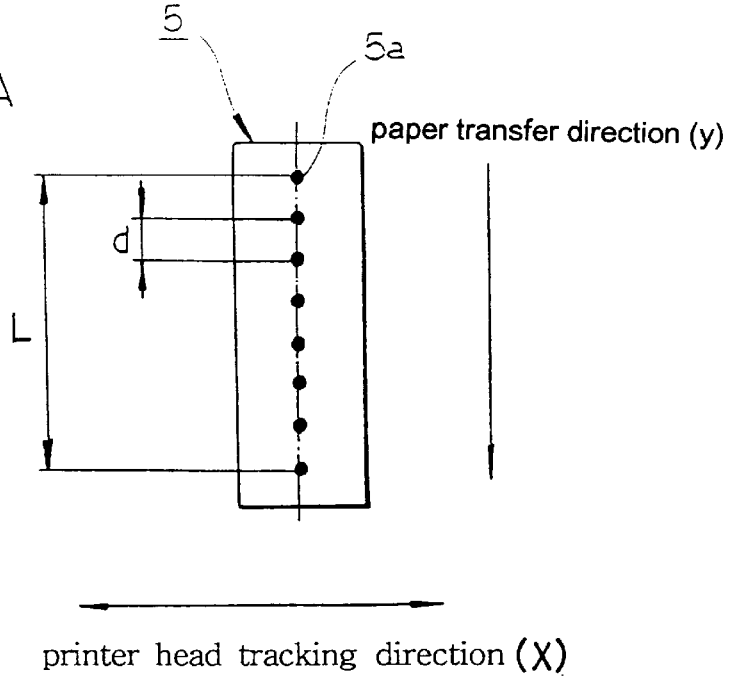
FIGS. 3A and 3B illustrate the operation of a typical nozzle array and printer head, with a conventional resolution control apparatus for an inkjet printer.
Figure 3B:
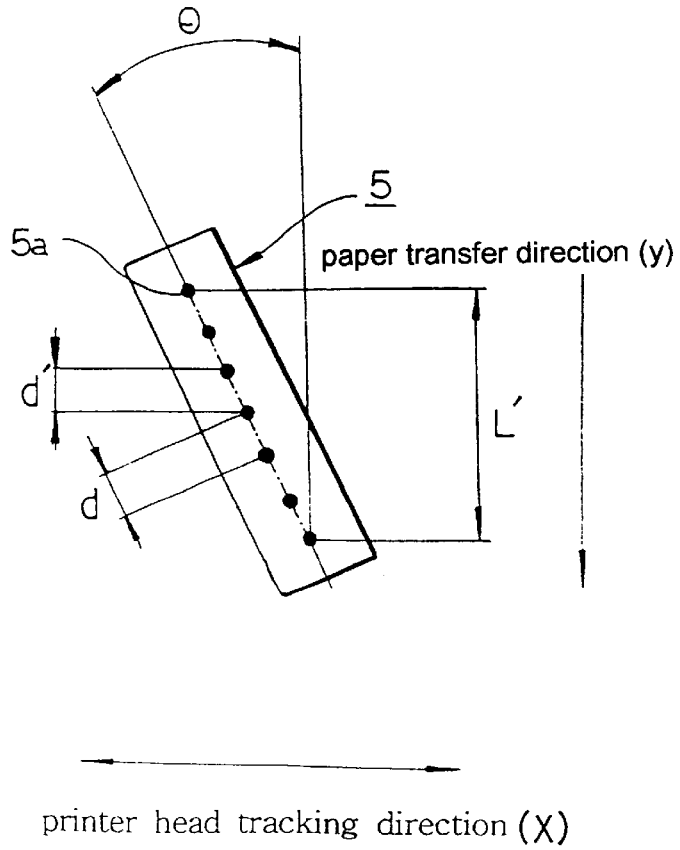
Figure 6:
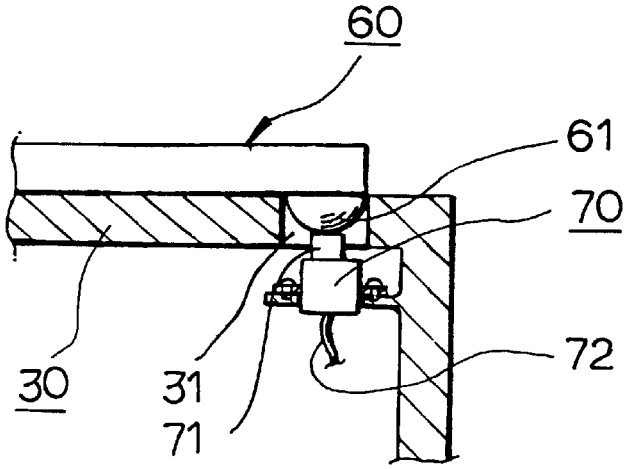
FIG. 6 is an enlarged view of section VI in FIG. 5.
Figure 7:
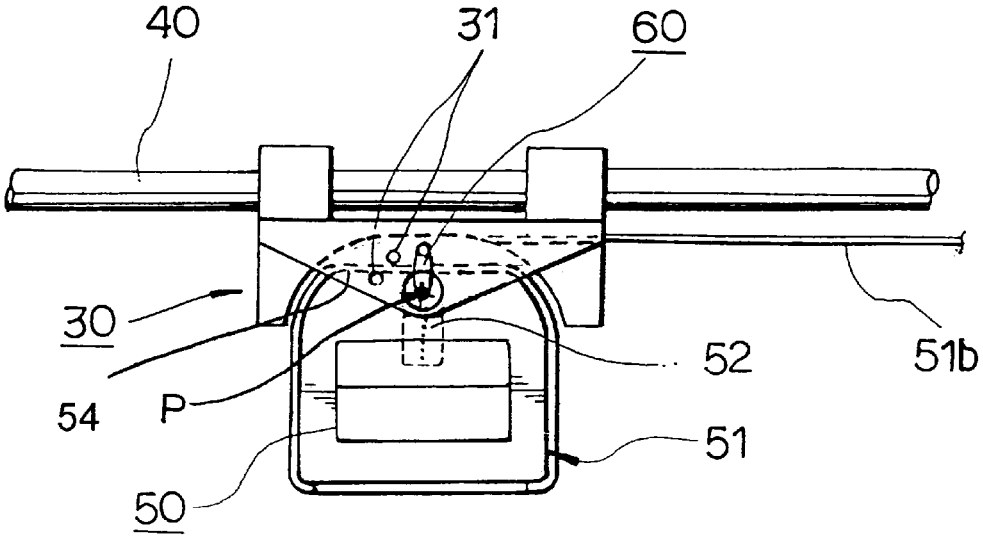
FIG. 7 is a plan view showing a printer head coupled with the carriage, in accordance with the principles of the present invention.

Turning now to FIGS. 3A, 3B, an effort to overcome this limitation uses a technique of setting an installation angle θ for printer head 5 to optimize vertical resolution without user control. As shown in FIGS. 3A and 3B, increased vertical resolution is achieved through the rotation of printing head 5 such that an effective nozzle interval d' is created along the Y-axis, which is shorter than the actual nozzle interval d as measured between neighboring nozzles 5*a*, while simply maintaining the same horizontal resolution. Here, the effective interval d' between the respective nozzles is kept as short as possible in order to achieve the best vertical resolution. With the nozzle diameters being 30~50 μm, however, and the nozzle interval d being 1/300th of an inch, I have found that there is a practical limit to the manufacture of such nozzles. I have also found that the printed line width is reduced so that the printing speed must be lowered. To illustrate, line width can be calculated as:

$$L=N(d-d') \quad (1)$$

$$L'=Nd \quad (2)$$

where L is the line width when the installation angle θ of printer head 5 is normal (FIG. 3A); L' is the line width when the installation angle θ, as measured between the near side of the print head and the guide rail, of printer head 5 is set for optimum vertical resolution (FIG. 3B); and N is the number of nozzles. Thus, since L is larger than L', although a somewhat higher resolution may be achieved by changing the installation angle of the printer head, the printing speed is inevitably slower. This technique is generally unsuitable for printers designed for high speed printing.

Reference will now be made in detail to the preferred embodiment of the present invention, in which FIGS. 4–9 show the resolution control apparatus for an ink-jet printer that may be constructed in accordance with the principles of the present invention. As in the conventional art, a carriage 30 for receiving a printer head 50 slides laterally along a guide shaft 40 under the motive power provided by a timing belt 20*a*.

The ink-jet printer of the present invention is provided with an angle controller that incrementally changes, the angle at which printer head 50 is installed within carriage 30, and a sensor that allows a control unit (not shown) to sense the installation angle of the printer head 50 changed by the angle controller.

Referring to FIGS. 4–7, the angle controller is installed in printing head holder 51. Holder 51 is rotatable about a pivot point P by arcuate rotation of lever 60 mounted on printer head 50 having an electrical contact portion 50*a*. The printing head holder 51 is coupled with a shaft 60*a* of the lever 60. Holder 51 has a rear wall 54 bearing an electrical contact portion 51 a that is electrically connected with the control unit via a flexible printing cable 51*b* (e.g., a ribbon cable). As printer head 50 is installed in printing head holder 51, their respective contact portions correspond so that a printing task may be performed according to print commands from the control unit. Lever 60 rotates both printing head holder 51 and printer head 50. Lever 60 has a hemispherical protrusion forming a detent 61 at a distal end. Detent 61 is engagable with each of a plurality of holes 31A, 31B, 31C formed in the exposed upper horizontal surface of carriage 30. Also positioned near each hole is a contact switch 70 that serves as a discrete sensor able to detect the presence detent 61 within hole 31A, 31B or 31C. Terminal 71 is activated (depressed) by hemispherical detent 61. An output control signal, representative of the respective contact switch 70 currently activated by detent 61 for the corresponding hole 31A–31C, is transmitted to the control unit via cable 72.

Figure 8:
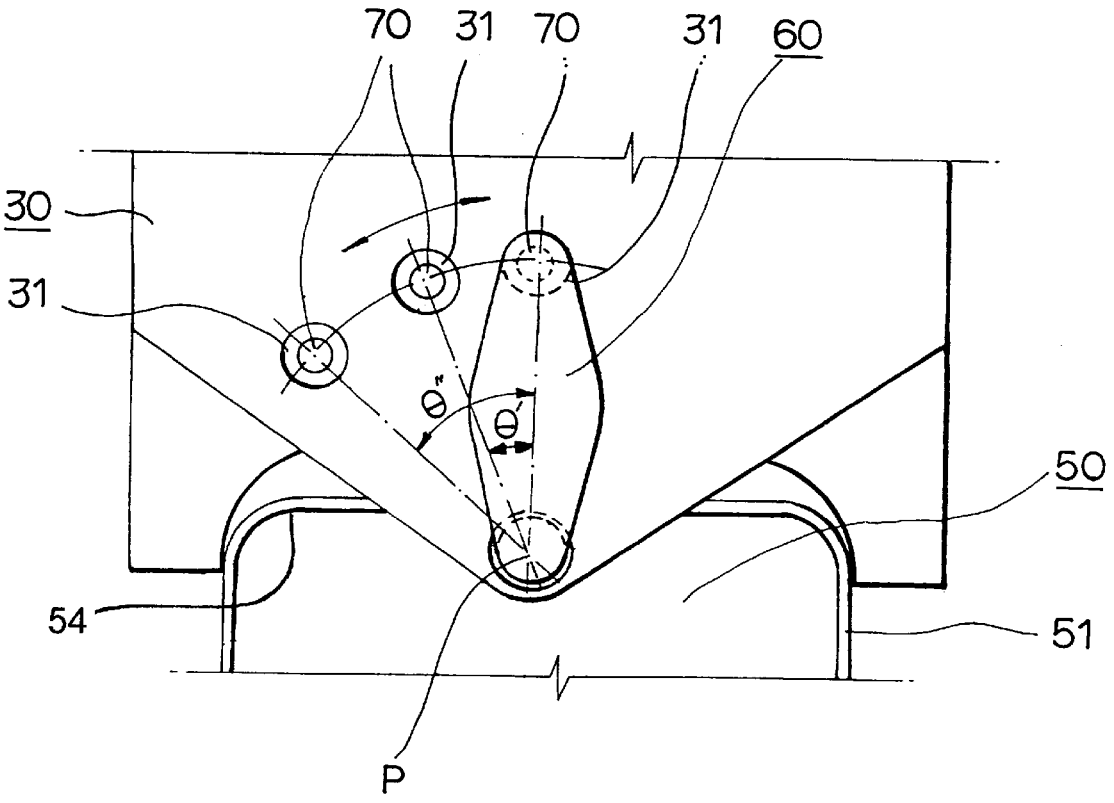
FIG. 8 is a plan view showing the operation of a lever that serves as angle controller, in accordance with the principles of the present invention.

Referring now to FIG. 8, as the lever 60 turns, both the printer head 50 and printing head holder 51 rotates about pivot point P by incremental angles θ', θ", . . . , or $\theta^n$, which, in turn, varies the installation angle of the printer head, as desired by the user operating the controller. Accordingly, the effective interval d' of the respective nozzles 52 of the printer head 50 is reduced with larger angles of rotation. When the installation angle of the printer head 50 is changed to control the vertical resolution of the printer with a given carriage transfer velocity, contact switches 70 sense the desired setting and send a corresponding signal, i.e., for high-resolution low-speed printing or, alternately, low-resolution high-speed printing, to the control unit for the proper control of the ink-jet printer.

Figure 9:
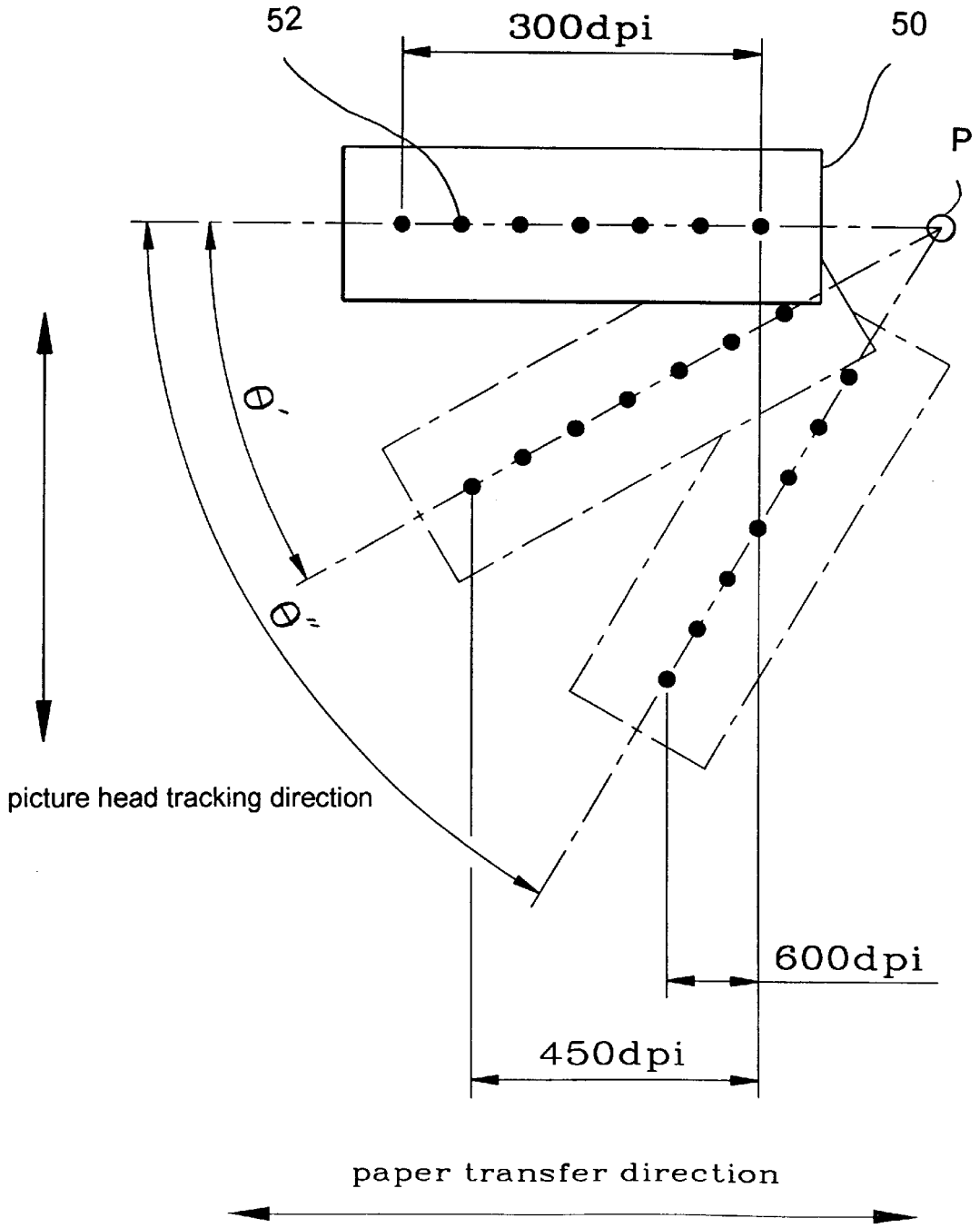
FIG. 9 illustrates the operation of a nozzle array and printer head, in accordance with the principles of the present invention.

In FIG. 9 it is assumed that the printer head has an array of nozzles 52 with an interval measurement of 300 dots per inch (dpi). For 600 dpi printing, the rotation angle of printer head 50 can be calculated as:

$$\cos\theta'' = \frac{300}{600} \quad (3)$$

$$\theta'' = 60° \quad (4)$$

Accordingly, to print at 450 dots per inch:

$$\cos\theta' = \frac{300}{450} \quad (5)$$

$$\theta' \approx 48.19° \quad (6)$$

The present invention provides a resolution control apparatus for an ink-jet printer which enables the user to select the installation angle of printer head 50 in incremental stages for two, or more, resolution settings. Once the installation angle is selected, the contact switches sense the desired resolution and send a control signal to a control unit. The control unit then controls the ink-jet printer for either high-resolution low-speed printing or low-resolution high-speed printing. This enables high quality ink-jet printing with having during a user-controlled printing operation.

As described in the foregoing paragraphs, the present invention provides a resolution control apparatus for an ink-jet printer that can control perpendicular resolution with respect to carriage movement, and an ink-jet printer that enables selection of higher vertical resolution at the appropriate printing speed.

It will be apparent therefore, to those skilled in the art that various modifications can be made in the spray device for an ink-jet printer of the present invention, without departing from the spirit of the invention. Thus, it is intended that the present invention cover such modifications as well as variations thereof within the scope of the appended claims.

What is claimed is:

1. A resolution control apparatus for a printer, comprising:

a carriage attached to and traveling along a guide shaft mounted inside said printer, said carriage bearing a plurality of discrete indicies each representative of a different orientation of said carriage relative to a direction of conveyance of a medium to be printed with images by said printer during said conveyance;

a printer head mounted in said carriage, said printer head having a rear side mounted adjacent to said guide shaft;

angle control means for incrementally adjusting the position of said carriage to change an installation angle of an array of elements carried by said printer head to form the images while said carriage reciprocatingly conveys said printer head along a path of travel traversing a width of the medium, with said installation angle being measured between a linear dimension defined by said array and a path traversed by the medium through said printer;

means tor indexing said installation angle; and sensing means operationally responsive to said indicies, for detecting said installation angle of the printer head by detecting from among said indicies one of said plurality corresponding to said orientation and generating a print control signal corresponding to said installation angle.

2. The resolution control apparatus according to claim 1, further comprised of said printer head having an array of discrete nozzles for ejecting ink from said printer head.

3. The resolution control apparatus according to claim 1, further comprising:

said carriage being perforated by a plurality of discrete holes defining corresponding ones of said indicies, said angle control means comprising a lever having a detent sequentially detachably engaged with successive ones of said plurality of discrete holes while rotating said printer head to change said installation angle; and a printing head holder that holds the printer head and is rotated by a movement of said lever.

4. The resolution control apparatus according to claim 1, wherein said sensing means comprises a plurality of contact switches each positioned to detect a different said orientation of said carriage.

5. The resolution control apparatus according to claim 4, comprised of each of said contact switches detecting a different said installation angle.

6. A resolution control apparatus for an ink-jet printer, comprising:

a carriage providing conveyance of an ink-jet cartridge bearing a linear array of discrete, spaced apart nozzles in reciprocating directions across a medium to be printed with images formed by ink emitted through the nozzles, said carriage bearing a configuration formed by a series of incrementally spaced stops;

a bracket pivotally mounted upon said carriage for supporting the ink-jet cartridge during said conveyance; and a lever controlling orientation of said array relative to a direction of conveyance of the medium through the printer by incrementally pivoting said bracket and the cartridge borne by said bracket as said lever serially engages said stops.

7. The resolution control apparatus according to claim 1, further comprised of said installation angle being approximately about 0.0 degrees while said printer prints at 300 dots per inch in a direction that a medium is transported through said printer.

8. The resolution control apparatus according to claim 1, further comprised of said installation angle being approximately about 48.19 degrees while said printer prints at 450 dots per inch in a direction that a medium is transported through said printer.

9. The resolution control apparatus printer according to claim 1, further comprised of said installation angle being approximately about 60 degrees while said printer prints at 600 dots per inch in a direction that a medium is transported through said printer.

10. An apparatus that controls the resolution of an ink-jet printer, comprising:

a carriage attached to and transporting along a guide shaft mounted inside said ink-jet printer;

a printer head mounted in said carriage, said printer head having a rear side mounted adjacent to said guide shaft;

angle control means for incrementally adjusting the position of said carriage to change an installation angle as measured between said guide shaft and said rear of said printer head, said angle control means comprising:

said carriage being perforated by a plurality of discrete holes, a lever having a detent sequentially detachably engaged with each of said plurality of discrete holes while rotating said printer head to change said installation angle; and a printing head holder that holds the printer head and is rotated by a movement of said lever; and sensing means for detecting said installation angle of the printer head and generating a print control signal corresponding to said installation angle.

11. The apparatus of claim 10, further comprised of said printer head having an array of discrete nozzles for ejecting ink from said printer head.

12. The apparatus of claim 10, wherein said sensing means comprises a plurality of contact switches each positioned to detect a different orientation of said angle control means.

13. The apparatus of claim 12, comprised of each of said contact switches detecting a different said installation angle.

14. The apparatus of claim 10, further comprised of said installation angle being approximately about 0.0 degrees while said ink-jet printer prints at 300 dots per inch in a direction that a medium is transported through said ink-jet printer.

15. The apparatus of claim 10, further comprised of said installation angle being approximately about 48.19 degrees while said ink-jet printer prints at 450 dots per inch in a direction that a medium is transported through said ink-jet printer.

16. The apparatus of claim 10, further comprised of said installation angle being approximately about 60 degrees while said ink-jet printer prints at 600 dots per inch in a direction that a medium is transported through said ink-jet printer.

17. A printer having an apparatus that controls printing resolution, comprising:

a carriage attached to and traveling along a guide shaft mounted inside said printer, said carriage bearing a plurality of discrete indicies each establishing a different orientation of said carriage relative to said guide shaft;

a printer head mounted in said carriage, said printer head having a rear side mounted adjacent to said guide shaft;

an angle controller incrementally adjusting the position of said carriage to change said orientation by varying an installation angle as measured between said guide shaft and said rear side of said printer head:

sensing means for detecting said installation angle of the printer head and generating a print control signal corresponding to said installation angle by indicating one of said indicies corresponding to said orientation;

means for indexing said installation angle; and said installation angle being a first acute angle while said printer prints at a first density in a direction that a medium is transported through said printer and said installation angle being a second and different angle while said printer prints at a different density in said direction.

18. The printer of claim 17, further comprising:

said carriage being perforated by a plurality of discrete holes defining said indicies; and, said angle control means comprising a lever having a detent sequentially detachably engaged with each of said plurality of discrete holes while rotating said printer head to change said installation angle.

19. The printer of claim 18, wherein said sensing means comprises a plurality of contact switches each positioned to detect a different said installation angle.

20. The printer of claim 19, further comprised of each of said contact switches detecting a different said installation angle.

21. A resolution control apparatus for a printer, comprising:

a carriage attached to and traveling along a guide shaft mounted inside said printer, said carriage bearing a plurality of discrete indicies each representative of a different orientation of said carriage relative to a direction of conveyance of a medium to be printed with images by said printer during said conveyance;

a printer head mounted in said carriage, said printer head having an array of discrete nozzles for ejecting ink from said printer head and a rear side mounted adjacent to said guide shaft;

angle control means for incrementally adjusting the position of said carriage to change an installation angle of an array of elements carried by said printer head to form the images while said carriage reciprocatingly conveys said printer head along a path of travel traversing a width of the medium, with said installation angle being measured between a linear dimension defined by said array and a path traversed by the medium through said printer;

a lever indexing said installation angle; and a sensor operationally responding to said lever by detecting said installation angle of the printer head from among said indicies one of said plurality corresponding to said orientation and generating a print control signal corresponding to said installation angle.

22. The resolution control apparatus according to claim 21, wherein said sensor comprises a plurality of contact switches each positioned to detect a corresponding said different orientation of said carriage.

23. The resolution control apparatus according to claim 21, further comprising: said carriage being perforated by a plurality of discrete holes defining corresponding ones of said indicies, said lever having a detent sequentially detachably engaged with successive ones of said plurality of discrete holes while rotating said printer head to change said installation angle.

24. The resolution control apparatus according to claim 21, wherein said sensor comprises a plurality of contact switches positioned to detect each said different orientation of said carriage.

25. The resolution control apparatus according to claim 21, further comprising:

said carriage being perforated by a plurality of discrete holes defining corresponding ones of said indicies; and movement of said lever rotating said printer head and changing said installation angle.

26. The resolution control apparatus according to claim 25, wherein said sensor comprises a plurality of contact switches each positioned to detect a corresponding said different orientation of said carriage.

27. The resolution control apparatus according to claim 22, comprised of each of said contact switches detecting a different said installation angle.

* * * * *